US007645221B1

(12) United States Patent
Curry

(10) Patent No.: US 7,645,221 B1
(45) Date of Patent: Jan. 12, 2010

(54) MULTI-ANGLE EXERCISE BALANCE PLATFORM

(76) Inventor: Mike Curry, 13910 Old Harbor La. #207, Marina Del Rey, CA (US) 90292

( * ) Notice: Subject to any disclaimer, the term of this patent is extended or adjusted under 35 U.S.C. 154(b) by 0 days.

(21) Appl. No.: 12/001,133

(22) Filed: Dec. 8, 2007

(51) Int. Cl.
*A63B 71/00* (2006.01)

(52) U.S. Cl. ..... 482/148; 482/34; 482/79; 482/142; 482/145

(58) Field of Classification Search ..... 482/146–147, 482/34, 79–80, 70–71
See application file for complete search history.

(56) References Cited

U.S. PATENT DOCUMENTS

| | | | | | |
|---|---|---|---|---|---|
| 1,509,750 | A | * | 9/1924 | Campbell | 482/26 |
| 1,671,096 | A | * | 5/1928 | Anderson | 482/79 |
| 3,497,217 | A | * | 2/1970 | Feather | 482/10 |
| 3,511,500 | A | * | 5/1970 | Dunn | 482/113 |
| 3,929,329 | A | * | 12/1975 | Rivera | 482/71 |
| 4,830,345 | A | * | 5/1989 | Mar | 267/133 |
| 5,062,629 | A | * | 11/1991 | Vaughan | 482/51 |
| 5,292,296 | A | | 3/1994 | Davignon | |
| 5,352,173 | A | * | 10/1994 | McLaughlin | 482/123 |
| 5,352,176 | A | * | 10/1994 | Huang | 482/146 |
| 5,421,800 | A | * | 6/1995 | Mullen | 482/121 |
| 5,509,871 | A | * | 4/1996 | Giovanni | 482/51 |
| 5,643,164 | A | | 7/1997 | Teff | |
| 5,865,715 | A | * | 2/1999 | Wallick | 482/124 |
| 5,897,474 | A | | 4/1999 | Romero | |
| 6,017,297 | A | | 1/2000 | Collins | |
| 6,652,432 | B2 | | 11/2003 | Smith | |
| 6,676,579 | B1 | * | 1/2004 | Lin | 482/146 |
| 6,705,975 | B2 | * | 3/2004 | Kuo | 482/79 |
| 6,705,977 | B1 | | 3/2004 | Ziak | |
| 6,719,676 | B1 | | 4/2004 | Hsu | |
| 6,740,008 | B1 | | 5/2004 | Ho et al. | |
| 6,761,666 | B2 | * | 7/2004 | Chou | 482/52 |
| D505,985 | S | | 6/2005 | Carbonero | |
| D507,026 | S | | 7/2005 | Chen | |
| 6,916,276 | B1 | | 7/2005 | Robinson | |
| 7,288,055 | B2 | * | 10/2007 | Blaum | 482/142 |
| 2004/9198573 | | | 10/2004 | Brydson et al. | |
| 2006/0217250 | A1 | | 9/2006 | Pearson | |
| 2007/0027010 | A1 | | 2/2007 | Tsai | |
| 2007/0117697 | A1 | * | 5/2007 | Genua | 482/146 |
| 2007/0184940 | A1 | * | 8/2007 | Tomes | 482/92 |

* cited by examiner

*Primary Examiner*—Lori Amerson
(74) *Attorney, Agent, or Firm*—Allan M. Shapiro

(57) ABSTRACT

An exercise device has a base, an exercise platform (which can be split into a left and right platform) and two or more springs that connect the base and the exercise platform(s) and hold the exercise platform(s) substantially parallel to the base when the exercise device is not in use, preventing the exercise platform(s) from coming into contact with the base when the exercise device is in use and allowing the position of the exercise platform to vary relative to the base as weight is applied to the exercise platform(s) at different points apart from a center point of weight balance while straps can be used to stabilize or selectively vary the center point of weight balance.

5 Claims, 7 Drawing Sheets

Muscles involved in lower body during squat position

Muscles involved in upper body during push-up position

MULTI-ANGLE EXERCISE BALANCE PLATFORM

FIELD OF THE INVENTION

The present invention is in the field of exercise devices.

BACKGROUND OF THE INVENTION

The exercise and fitness industry is big business. It has gyms, certified trainers and many different companies that manufacture, distribute and sell exercise devices and equipment. And the market for such services and devices is enormous.

It is well known that exercise, in proper moderation, is extremely beneficial to the human body. It is also well known that there are many different exercises and exercise devices for exercising different muscles in the human body, and that variety in an exercise routine can make the difference between success and failure. Finally, it is also well known that while exercise devices can be complicated, expensive and space consuming, many consumers look for compact, inexpensive, safe and practical exercise devices for use anywhere, and there is always a need for such devices, especially if they will help exercise the so-called core muscles of the body.

One type of exercise device that has achieved success is an exercise ball. It can be deflated, so it is compact, it is inexpensive, safe and can be used in a variety of locations, and it can be used in a variety of different ways to exercise the core muscles of the body. There are also other exercise devices that allow for balancing the body during exercise, examples of which U.S. Pat. Nos. 5,292,296, 5,643,164, 5,897,474, 6,017,297, 6,652,432, 6,705,977, 6,719,676, 6,916,276, D505,985, D507,026 and U.S. Patent Publication Nos. US2004/0198573 A1, US2006/0217250 A1, and US2007/0027010 A1.

The present invention seeks to fulfill the need for improved exercise devices by providing a new exercise device that is compact, inexpensive, safe and simple to use, that can be used in a variety of locations to exercise a variety of different muscles, and especially core muscles, while providing a wide variety of options for custom workouts to maintain and stimulate user interest.

The present invention does all of these things by providing a multi-purpose, multi-angle balance exercise board that is compact, inexpensive, safe and practical for use in a variety of locations. It differs from prior exercise devices in its use of more than one spring coil for multiple functions and resistances that offers users a variety of levels ranging from beginner to advanced and the present invention can be used for an endless variety of exercises such as (1) dual leg squats; (2) single leg squats; (3) stationary and alternating lunges; (4) step-ups; (5) squat jumps; (6) upper body push-ups; and (7) oblique twists. Additional types of exercise equipment like bands, cables and free weights can be incorporated into each of these particular exercises, allowing the user an infinite possibility of custom workouts. The motion of the present invention's spring coils offers a full range of positions, targeting multiple muscle groups simultaneously. Accordingly, the present invention provides a multi-angled balance exercise board that can be used in a variety of different angles for exercising various parts of the body simultaneously while maintaining focus on stabilization.

SUMMARY OF THE INVENTION

The present invention is generally directed to an exercise device with a base, an exercise platform and a plurality of springs connecting the base and the exercise platform that hold the exercise platform substantially parallel to the base when the exercise device is not in use, prevent the exercise platform from coming into contact with the base when the exercise device is in use and allow the position of the exercise platform to vary relative to the base as weight is applied to the exercise platform at different points apart from a center point of weight balance.

In a first, separate group of aspects of the present invention, the exercise device also includes a safety handle detachably connected to the base that extends above the exercise platform and is positioned away from a top edge of the exercise platform so as to provide support for a user standing on the exercise platform and the exercise platform can include left and right hand grips located at left and right edges of the exercise platform.

In other, separate aspects of the present invention, the plurality of springs can be two springs mounted on the base such that a line formed between the springs will intersect a left and a right edge of the exercise platform, or two springs mounted on the base such that a line formed between said two springs will intersect a top and a bottom edge of the exercise platform, or a left spring, a middle spring and a right spring mounted on the base such that a line formed between the springs will intersect a left and a right edge of the exercise platform and wherein the middle spring has more tension than either the left or right springs, or a top left spring, a top right spring, a bottom left spring and a bottom right spring and said springs create a center point of weight balance on the exercise platform. In addition, at least four straps, each of which is detachably connected between the base and the exercise platform, can be positioned so as to stabilize the center point of weight balance on the exercise platform when they are all connected to both the base and the exercise platform.

In still other, separate aspects of the present invention, the exercise platform can be divided into a left exercise platform attached to a left spring and a right exercise platform attached to a right spring with both exercise platforms capable of moving independently relative to each other. In addition, three left straps can be detachably connected between the base and the left exercise platform and three right straps detachably connected between the base and the right exercise platform with a connecting strap detachably connected between the left and right exercise platforms, with such straps being positioned so as to stabilize the center point of weight balance when they are all connected.

In a further, separate aspect of the present invention, a method of exercising is provided in which either a pair of hands or a pair of feet is chosen as a pair of points of contact of a user with two points on an exercise platform in accordance with the present invention, and then either the hands or feet contact two points on the exercise platform while the user exercises while trying to maintain stability on the exercise platform. A user may optionally use a safety handle positioned away from the exercise platform to assist in maintaining stability during exercising and at least one strap of an exercise platform in accordance with the present invention can be disconnected to cause the center point of weight balance of the exercise platform to vary.

Accordingly, it is a primary object of the present invention to provide an improved exercise device.

This and further objects and advantages will be apparent to those skilled in the art in connection with the drawings and the detailed description of the preferred embodiment set forth below.

DETAILED DESCRIPTION OF THE INVENTION

Figure 1:
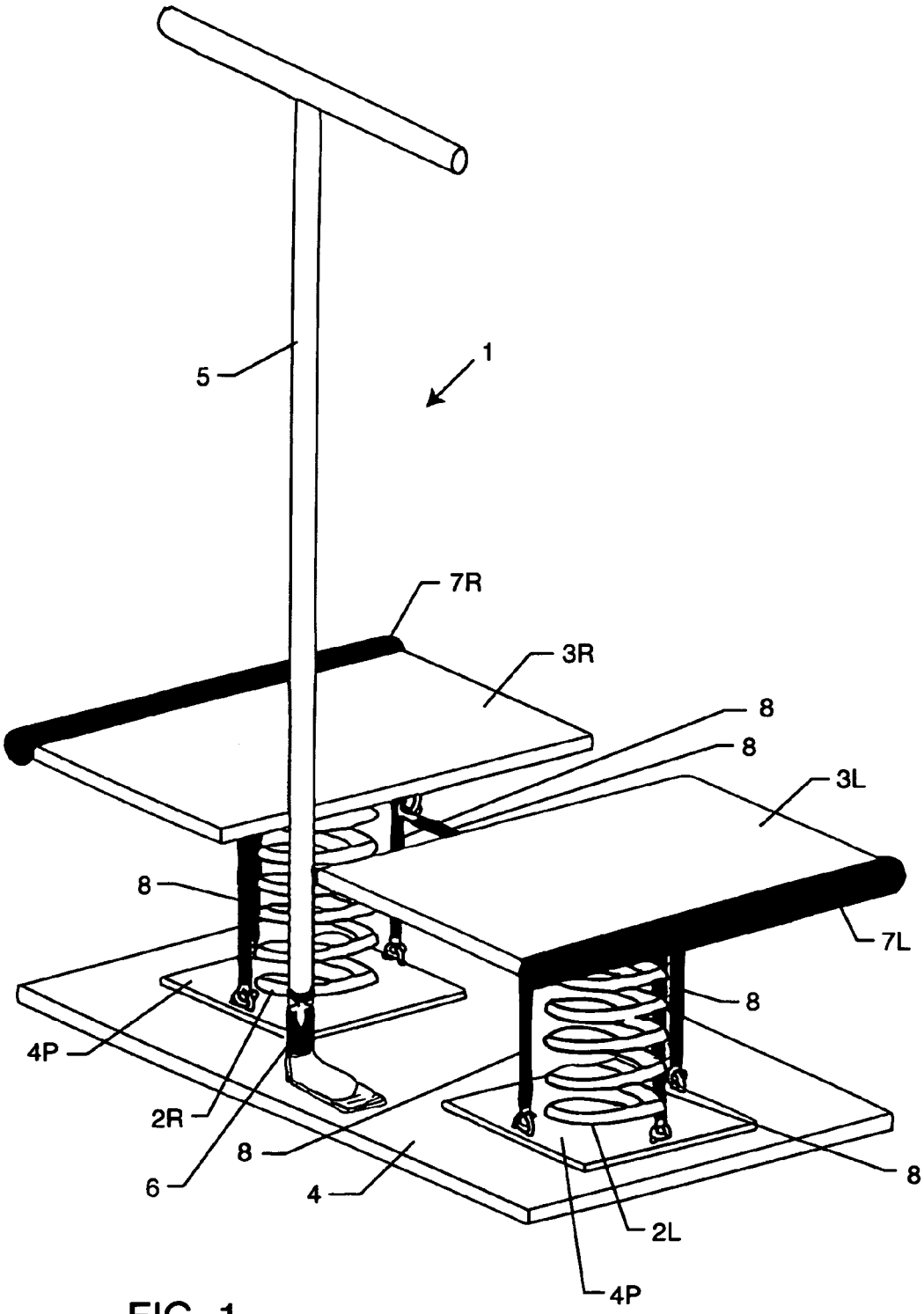
FIG. 1 illustrates one preferred embodiment of the present invention that utilizes two separate exercise platforms.

In this day and age, exercise is all about stabilization, working your core for strength, balance, stability, and better posture. Time is a major factor in working out several parts of the body in a specific, scheduled and limited time. To have a device that forces your body to stabilize while performing various exercises is the key to staying fit. The present invention does just that. Whether one is curling one's biceps or pressing one's shoulders, the present invention forces one to work the entire core—legs, glutes, abdominals, obliques, by stabilization.

How is this Done?

When you walk or stand on common ground, the ground you walk on is stable. Just as you would walk up an incline, you would naturally lean your body forward to counter your weight, so you can get up that hill without falling back. The present invention moves in every direction, not allowing the body to completely stabilize thus constantly attempting to counter your bodyweight. While on a physical embodiment of the present invention, your body frantically searches for stabilization. While the body searches for this comfort zone, it is contracting every muscle in the body. Every time your muscles contract, the heart must pump blood to those working muscles. The more muscles working the more blood the heart has to pump. This takes energy from the body for this to happen. Energy is in the form of calories. As is well known, we work out to burn calories, to create that deficit. The more we can burn in one workout, the better, and we get stronger in the process.

The present invention strengthens the mid-section, helping make everyday balance issues in life much easier. Whether one plays sports or just wants to feel better physically, which in turn causes one to feel better emotionally and mentally, the present invention provides and exercise device that can suit everyone.

In addition, the present invention is great for focusing on upper body strength. It's all about how it is used. The present invention is designed primarily for one to stand on it, yet it works just as well when applying one's hands to the push-up handgrips located on each side of the platform. This brings on a whole new element to the present invention. Standing on a physical embodiment of the present invention allows ones' hands to be free, if not using the safety handlebars. By simply adding weight to one's workouts on the exercise platform, one can focus on one's chest, shoulders, triceps, abdominals, obliques, serratus, and various muscles of the back, and leg lifts and oblique twists can all be done while hands are on the platform to add difficulty to such exercises.

The present invention will now be discussed in connection with preferred embodiments illustrated in FIGS. 1-7.

In the Figures and the following more detailed description, numerals indicate various features of the invention, with like numerals referring to like features throughout both the drawings and the description. Although the Figures are described in greater detail below, the following is a glossary of the elements identified in the Figures.

| | |
|---|---|
| 1 | exercise device |
| 2L | left spring |
| 2R | right spring |
| 2T | top spring |
| 2B | bottom spring |
| 2TL | top left spring |
| 2TR | top right spring |
| 2BL | bottom left spring |
| 2BR | bottom right spring |
| 2C | center spring |
| 2LM | left middle spring |
| 2RM | right middle spring |
| 3 | exercise platform |
| 3L | left exercise platform |
| 3R | right exercise platform |
| 4 | base |
| 4P | base plate |
| 5 | safety handle |
| 6 | swivel socket |
| 7L | left grip |
| 7R | right grip |
| 8 | strap |

Several preferred embodiments of an exercise device 1 in accordance with the present invention are illustrated in FIGS. 1-5. Each exercise device 1 has a base 4 to which two or more springs are attached. Each spring is, in an especially preferred embodiment, a spring coil that is attached (preferably by welding) to a base plate 4P at one end which is connected to base 4 and attached (preferably by welding) to a platform plate (not shown) at its other end which is connected to an underside of an exercise platform.

It is especially preferred that each exercise device 1 have a safety handle 5 detachably connected to base 4 by a swivel socket 6 which allows handle 5 to lock at level position or move freely, at the discretion of the user. The user holds handle 5 during exercise for safety and support, which allows the more inexperienced user to use exercise device 1 without fear of injury. When swivel socket 6 is loose, a person can use handle 5 (which is preferably in a T-bar shape) to help counter his or her weight. When handle 5 is in the locked position it enables a user easy on and off access to the platform of exercise device 1.

It is also especially preferred that each exercise device 1 have left and right grips (7L and 7R) to ensure lateral traction. The grips are designed for a better grip while performing a stabilizing push-up and/or any other upper body exercise and serve as a foot placement for safety and to help keep feet from sliding off each lateral end of the exercise platform. The grips also serve as handles for easy mobility of placing exercise device 1 in different locations. In addition, adhesive grip tape (not shown) can be placed on the top surface of the exercise platform to provide traction and help prevent feet from sliding off the exercise platform when exercise device 1 is in use.

The present invention allows a user to exercise his or her entire body with the key emphasis on the core. By using a user's center of gravity as a focal point, a user must attempt to stabilize his or her position on the platform of exercise device 1 while performing various exercises. The present invention creates an unstable platform that can demand every muscle to contact in search of stabilization, and the present invention is not limited to lateral moves. The spring coils working together challenge users to hit any angle, and even circular and twisting moves are possible. Alternate preferred embodiments of the present invention incorporate different spring coils, each offering a unique measure of tension (pounds per square inch) for a full range of motion in more advanced degrees.

In a preferred embodiment of the present invention, the springs are spring coils originally designed for use with automobiles that can withstand 1,500 pounds. Such coils should be able to endure the weight of a human body, even when the body is obese, and should be capable of prolonged use without being broken down or compromised with the passage of time under normal use. The spring coils will hold the exercise platform(s) of exercise device 1 substantially parallel to base 4 when the exercise device is not in use and are sufficiently stiff so that they will prevent the exercise platform(s) from coming into contact with base 4 when a user is exercising with exercise device 1 yet they are not too stiff to prevent movement since they allow the position of the exercise platform(s) to vary relative to base 4 as weight is applied to the exercise platform(s) at different points apart from a center point of weight balance.

FIG. 1 illustrates an exercise device 1 having a left exercise platform 3L connected by left spring 2L to base 4 and a right exercise platform 3R connected by right spring 2R to base 4. This is the most advanced embodiment of the present invention because it allows the user to balance each exercise platform individually. In this embodiment, straps 8 are positioned so as to stabilize left and right exercise platforms 3L and 3R when they are attached, and FIG. 1 illustrates the use of six straps 8 that are attached above, below and to the outer side of the platforms as measured between their respective spring and safety handle 5. In addition, one or more straps 8 can be fastened between left and right exercise platforms 3L and 3R, in which case the strap(s) can conveniently be fastened to an underneath side of the respective exercise platforms. When one or more of straps 8 are disconnected, the difficulty of stabilizing an exercise platform will be increased during exercise, and, by deciding which strap(s) are disconnected, the center point of weight balance of the exercise platform(s) can be varied.

Figure 2:
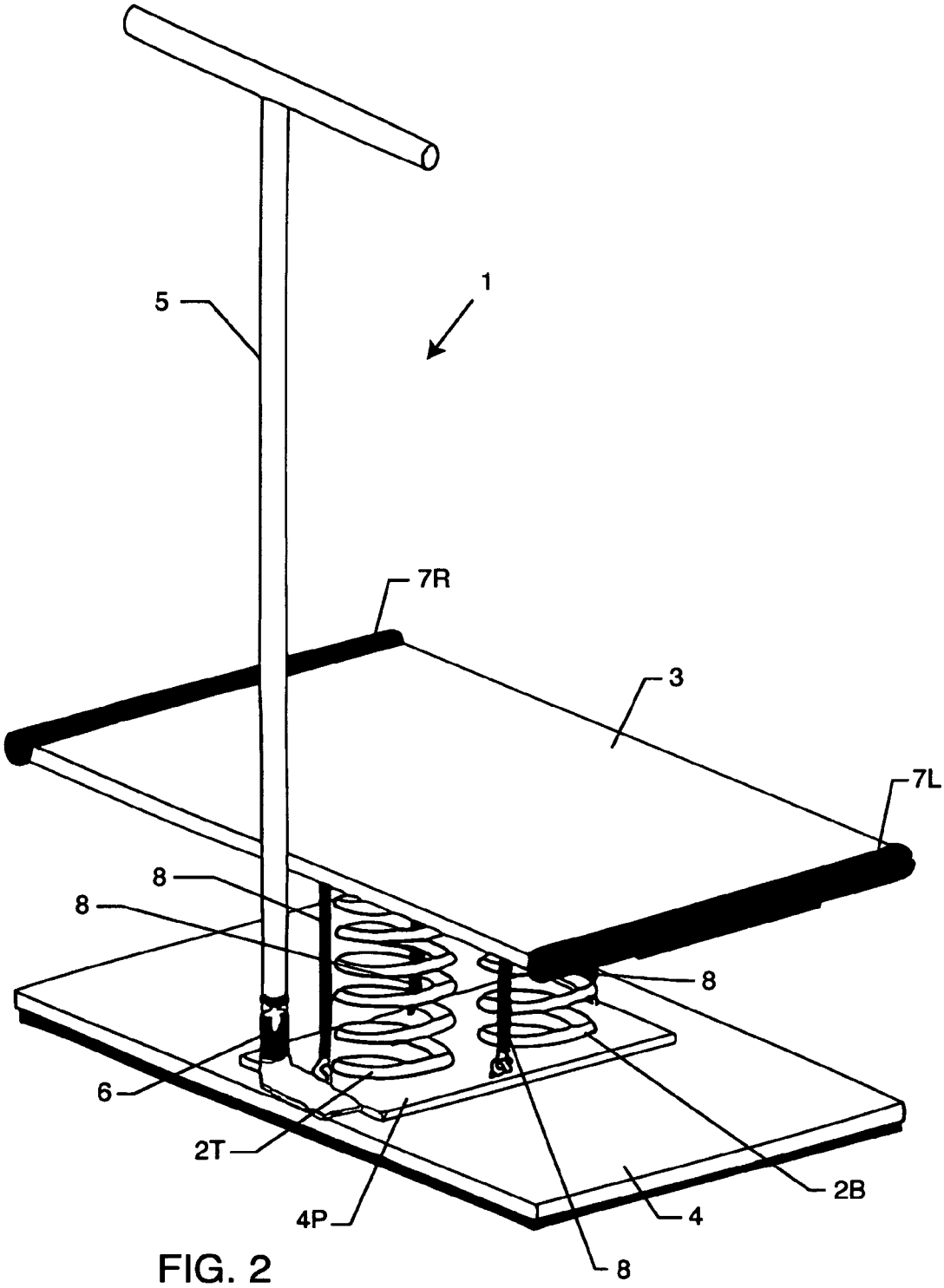
FIGS. 2-5 illustrate another preferred embodiment of the present invention that utilizes a single exercise platform and differing configurations of springs.

FIG. 2 illustrates an exercise device 1 with a single exercise platform 3 and two springs 2T and 2B that are aligned with handle 5 so that a line formed between the two springs will intersect a top and a bottom edge of the exercise platform. As was the case with the exercise device of FIG. 1, this embodiment can be stabilized by straps 8, which can be selectively disconnected to vary the center point of weight balance of exercise platform 3, except there are now only four straps placed about the springs, instead of the six or more straps needed to stabilize two separate exercise platforms.

Figure 3:
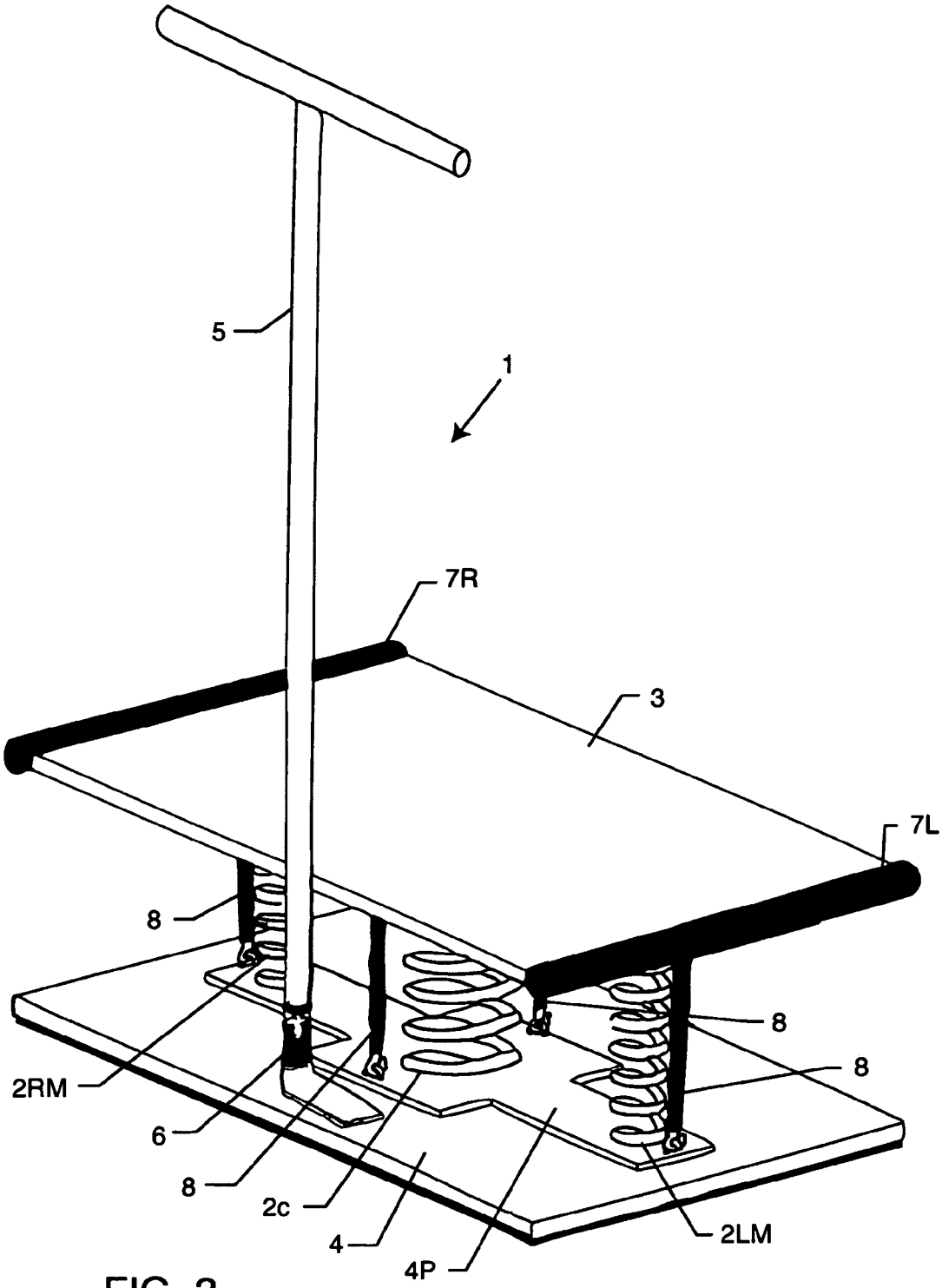

FIG. 3 illustrates an exercise device 1 having three springs in which center spring 2C has a greater tension than left spring 2L and right spring 2R. By varying the placement of the two or more springs underneath exercise platform 3, or their tensions, an appropriate center point of balance can be varied, depending upon intended use of exercise device 1. In this particular embodiment, the placement and tension of the springs makes it easier for lateral movements while keeping it safe, and this particular embodiment is especially well suited for those who want to learn how to stabilize the muscles needed for surfing.

Figure 4:
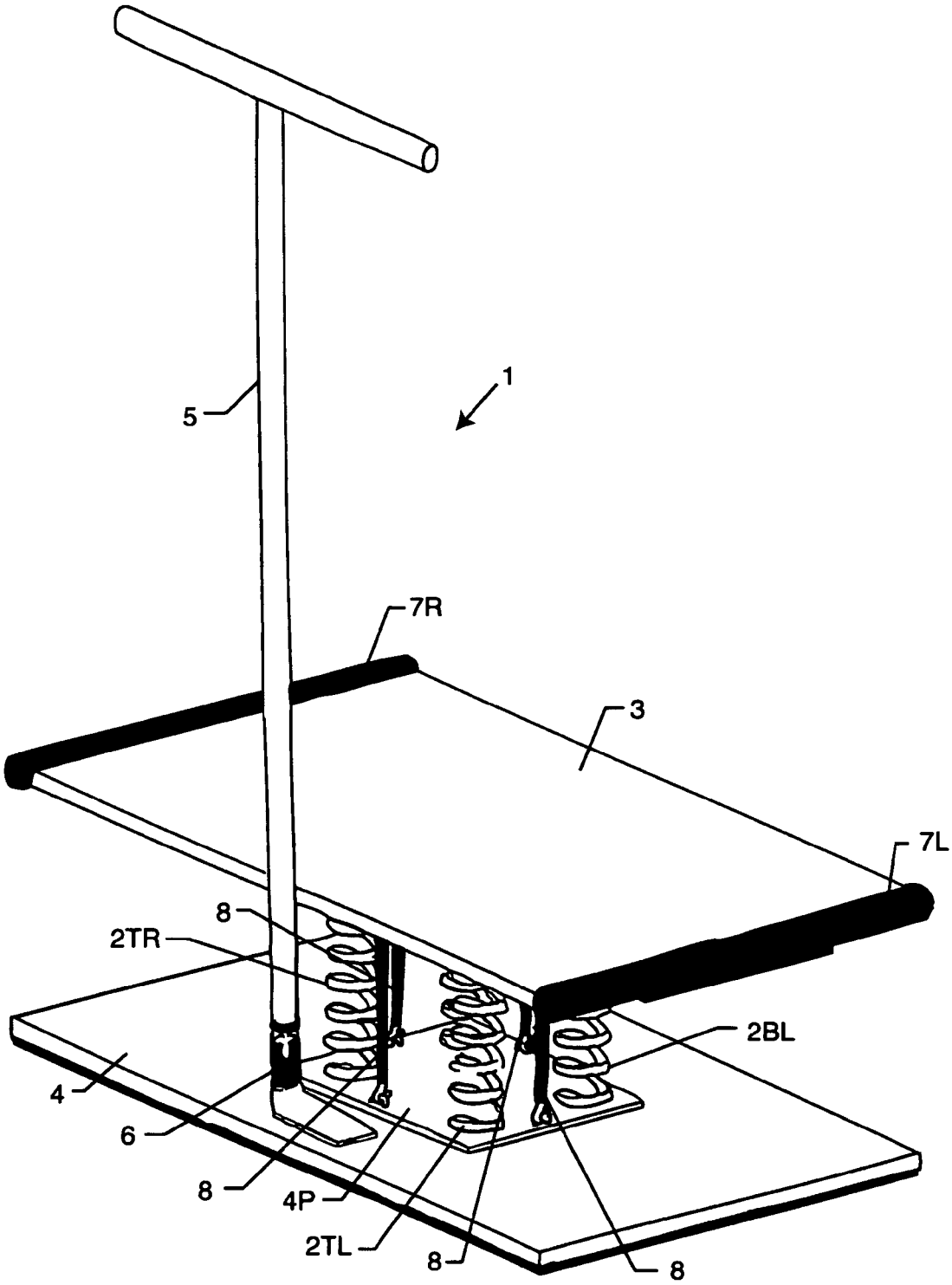
Figure 5:
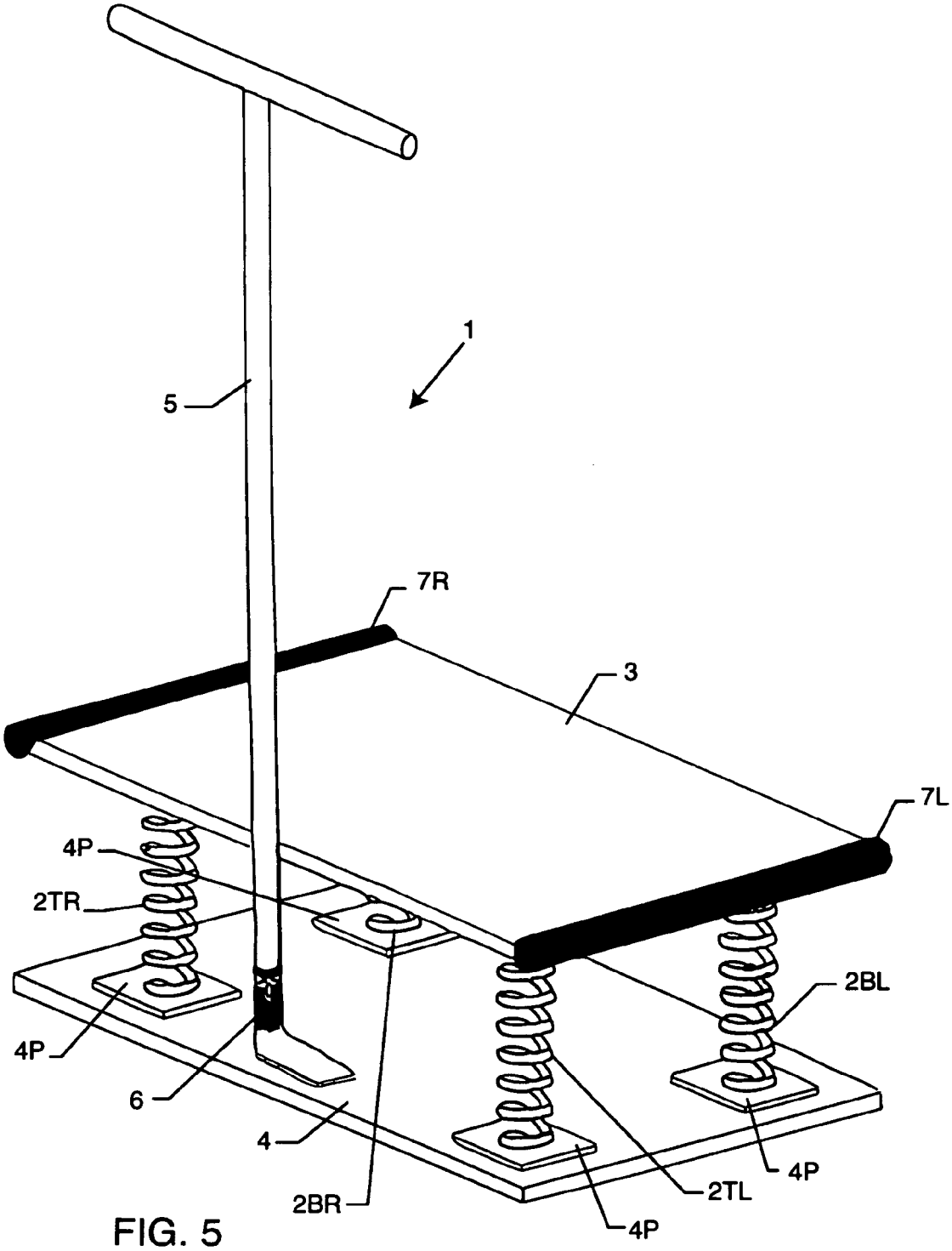
Figure 6:
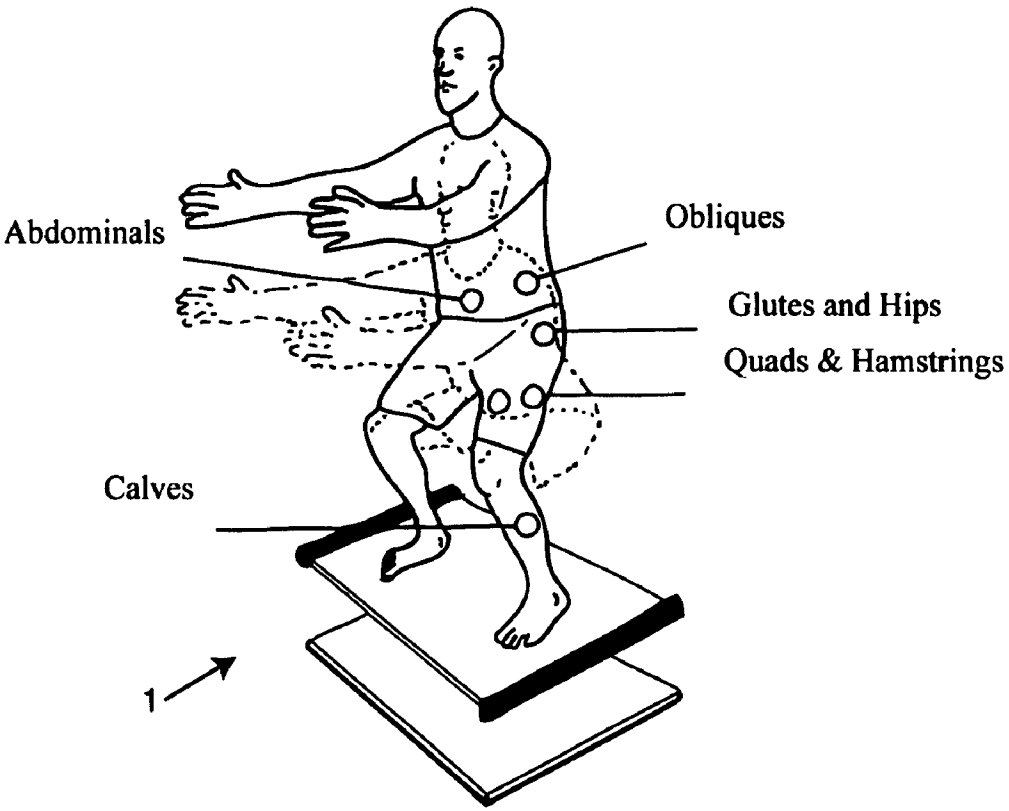
FIG. 6 illustrates the muscles of the upper body involved in using the exercise platform of the present invention during a push-up position.
Figure 7:
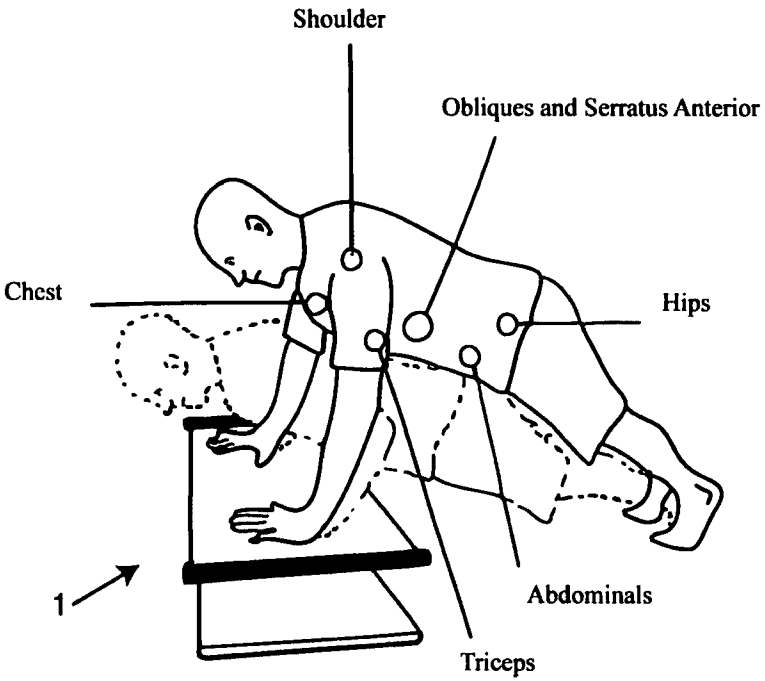
FIG. 7 illustrates the muscles of the lower body involved in using the exercise platform of the present invention during a squat position.

FIG. 4 illustrates an exercise device 1 having four smaller springs in the center of exercise platform 3 while FIG. 5 illustrates the easiest embodiment shown in which the four springs have been moved out to the four corners of exercise platform 3 to give a smooth way in the exercise design. Of course, as was the case with the embodiments illustrated in FIGS. 1 and 2, straps 8 can be used to provide additional stability or to allow for varying the center point of weight balance as they are selectively detached.

While the invention has been described herein with reference to certain preferred embodiments, those embodiments have been presented by way of example only, and not to limit the scope of the invention. Additional embodiments thereof will be obvious to those skilled in the art having the benefit of this detailed description. Further modifications are also possible in alternative embodiments without departing from the inventive concept.

Accordingly, it will be apparent to those skilled in the art that still further changes and modifications in the actual concepts described herein can readily be made without departing from the spirit and scope of the disclosed inventions as defined by the following claims.

What is claimed is:

1. An exercise device, comprising:

a base, said base having an undersurface for placement on the floor and having an upper surface;

a plurality of springs, each of said plurality of springs having a first end and a second end;

an exercise platform, said exercise platform having a top surface for engagement by the user and having an undersurface;

each of said plurality of springs being affixed at said first end to an upper surface of said base and at said second end to an undersurface surface of said exercise platform said exercise platform being substantially parallel to said base when said exercise device is not in use, said springs being a sole support for said platform; a plurality of flexible unitary straps, each of said straps having a first end and having a second end, each of said straps having said first end connected to said upper surface of base and said second end connected to said undersurface surface of exercise platform, said straps being sized and positioned so that they are in tension when there is no external load on said platform to stabilize the balance of said exercise platform;

a socket mounted on said top surface of said base, a one-piece safety handle mounted in said socket, said one-piece safety handle having a top and having a cross bar formed in a T-bar shape so that the user of said exercise device can stand on said exercise platform and hold said handle for safety and support; and said plurality of springs and said straps being the sole constraints of said platform so that said springs and said straps allow the position of said exercise platform to vary relative to said base as weight is applied to said exercise platform at different points away from a center point of weight balance.

2. The exercise device of claim 1, wherein said safety handle is detachably connected to said base so that it extends above said exercise platform, said safety handle being positioned away from a top edge of the exercise platform so as to permit said exercise platform to move without contacting said handle and to provide support for a user standing on the exercise platform.

3. The exercise device of claim 1, further comprising:

a left hand grip located at a left edge of said exercise platform; and a right hand grip located at a right edge of said exercise platform.

4. The exercise device of claim 1, wherein the exercise platform is comprised of a left exercise platform attached to a left one of said springs and a right exercise platform attached to a right one of said springs and the said left and right exercise platforms are capable of moving independently relative to each other, and a unitary strap having left and right ends, said left end of said unitary strap being connected to said left exercise platform and said right end of said unitary strap being connected to said right exercise platform.

5. An exercise device, comprising:

A flat bottomed base having a bottom surface and a top surface;

a left exercise platform, said left exercise platform having a top surface sized and configured to receive a human foot and having a bottom surface, said left exercise platform having a left hand grip located at the left edge of said left exercise platform;

a right exercise platform, said right exercise platform having a top surface sized and configured to receive a human foot and having a bottom surface, said right exercise platform having a right hand grip located at the right edge of said right exercise platform;

a left spring having a first end and having a second end, said left spring being affixed at said first end to said top surface of said base and at said second end to said bottom surface of said left exercise platform;

a right spring having a first end and having a second end, said right spring being affixed at said first end to said top surface of said base and at said second end to said under surface of said right exercise platform, said right and left exercise platforms being only spring supported;

a plurality of unitary flexible straps each having a first end and a second end, at least two of said straps having their first ends connected to said base and having their second ends connected to said left exercise platform and at least two of said straps having their said first ends connected to said base and their said second ends connected to said right exercise platform so that said straps limit motion of said exercise platform with respect to said base;

a unitary connecting strap having a left end and having a right end, said left end of said connecting strap being connected to said left exercise platform and said right end of said connecting strap being connected to said right exercise platform to limit motion of said right exercise platform with respect to said left exercise platform, said springs and said straps being the only constraints on motion of said left and right exercise platforms with respect to said base;

a swivel socket secured to said top surface of said base;

a one-piece safety handle mounted in said swivel socket so that it extends above said left and right exercise platforms, said safety handle being positioned away from a top edge of said left and right exercise platforms and between said left and right exercise platforms; and said left and right springs being configured to prevent said left and right exercise platforms from coming into contact with each other or said base when a user is exercising with said exercise device and allow the position of each of said left and right exercise platforms to vary in position relative to said base and each other as weight is applied to said left and right exercise platforms away from the center point of weight balance.

* * * * *